US005265875A

United States Patent [19]

Fitzgerald

[11] Patent Number: 5,265,875

[45] Date of Patent: Nov. 30, 1993

[54] REDUCED AREA, NIGHT PLAYABLE GOLF COURSE

[76] Inventor: John H. Fitzgerald, 5631 Timber Rail, San Antonio, Tex. 78250

[21] Appl. No.: 894,524

[22] Filed: Jun. 5, 1992

Related U.S. Application Data

[63] Continuation of Ser. No. 734,531, Jul. 23, 1991, abandoned.

[51] Int. Cl.[5] ..... A63B 69/36

[52] U.S. Cl. ..... 273/176 A; 273/176 K; 273/176 L; 273/181 F; 362/431

[58] Field of Search ..... 273/176 R, 176 A, 176 AB, 273/176 B, 176 FA, 177 R, 178 R, 181 R, 35 R, 32 R, 35 B, 183 R, 181 A, 181 F; 362/431

[56] References Cited

U.S. PATENT DOCUMENTS

| | | | |
|---|---|---|---|
| 1,851,423 | 3/1932 | Ely | 273/176 A |
| 1,869,642 | 8/1932 | Woolman | 273/176 |
| 2,003,074 | 5/1935 | Gage | 273/176 |
| 2,248,053 | 7/1941 | Bales | 273/176 A |
| 2,455,806 | 2/1948 | Reach | 273/176 |
| 2,482,210 | 9/1949 | Reach, Sr. et al. | 273/176 |
| 2,701,140 | 2/1955 | Fortino | 273/176 R |
| 3,104,879 | 9/1963 | Jetton | 273/177 A |
| 3,504,912 | 4/1970 | Jenney | 273/176 |
| 3,599,980 | 8/1971 | Harmond | 273/176 A |
| 3,685,832 | 8/1972 | Johnson | 273/176 A |
| 3,708,173 | 1/1970 | Hewson, Jr. | 273/176 A |
| 3,918,719 | 11/1975 | Welch | 273/176 R |
| 3,990,708 | 11/1976 | Ingwerson | 273/176 A |
| 4,063,738 | 12/1977 | Michalson | 273/176 A |
| 4,161,723 | 7/1979 | DeVittori | 362/431 |
| 4,177,944 | 12/1979 | Lindquist | 273/176 FA |
| 4,696,474 | 9/1987 | Tegart | 273/176 A |
| 4,846,478 | 7/1989 | Saint-Cricq | 273/176 A |

FOREIGN PATENT DOCUMENTS

| | | | |
|---|---|---|---|
| 1086566 | 10/1967 | United Kingdom | 273/176 A |
| 2206496 | 1/1989 | United Kingdom | 273/35 B |

OTHER PUBLICATIONS

Shenton, Twenty-Four Hours of Golf a Day Rain or Shine 1929, pp. 30, 32.

Literary Digest, Golf Twenty-Four Hours a Day, Jul. 1929, p. 20.

*Primary Examiner*—Mark S. Graham

*Attorney, Agent, or Firm*—Gunn, Lee & Miller

[57] ABSTRACT

A reduced area, night playable golf course is achieved by utilizing a common driving area for all par 4 and par 5 holes on the course. Separate laterally spaced tees are provided at one end of the driving area for each hole. The ball landing region of the driving area is covered by a grid of ball catching nets having relatively small areas. A ball caught by a particular net is directed to a ball return conduit which includes a ball actuated switch which inputs a signal to a computer which records the distance and lateral position of the ball as two coordinates which are printed on the player's score card. The playing course is conventionally constructed, except that the initial 100 to 150 yards of each par 4 and par 5 hole is omitted. A grid pattern of markers bearing coordinates corresponding to those of the ball catching nets is installed in the initial portions of the par 4 and par 5 holes and the ball is dropped for the second shot adjacent the marker showing the coordinates of the drive. For night play, the markers are ground level, transparent covers for telescopically mounted, subsurface, tubular light posts having a low wattage internal light. Elevation of any light post above ground level provides sufficient light to hit a ball dropped or landing in the immediate vicinity of a subsurface light post, which are provided in a grid pattern over all of the playable portions of the course.

14 Claims, 6 Drawing Sheets

REDUCED AREA, NIGHT PLAYABLE GOLF COURSE

RELATIONSHIP TO PENDING APPLICATION

This application is a continuation of pending U.S. patent application Ser. No. 07/734,531 filed on Jul. 23, 1991, now abandoned.

BACKGROUND OF THE INVENTION

1. Field of the Invention

Applicant's invention relates to the design of a golf course, including apparatus usable thereon, to permit a normal game of golf to be played on a course requiring substantially reduced total area and providing illumination for night playing without incurring substantial energy expense.

2. Background Information

There are serious problems in the golf industry at the present time and in order to understand how these problems developed, we must start at the origin of the game. When the game of golf was invented in Scotland centuries ago, it was played along the seashore on land sites that were unsuitable for just about anything except golf. The basic rules of golf have not changed substantially, with the exception of clarifying amendments. The only major modernization of the game has been in the equipment used to play the game. Ironically this has, in a sense, been a setback, because the new clubs and balls were designed to make the ball go further, thus emphasizing the need of new courses to be longer, not shorter, and hence, for the average golfer, take more time to play.

The time element is the crux of the problem, because people do not like waiting around to hit their next shot and, in most cases, simply cannot spare the time required for a full round of eighteen holes of golf. Thus, the golf courses must charge more because of the low number of rounds played and constantly increasing maintenance costs. As a result, further expansion of the golfing industry is unlikely because of the time constraints and the very high price now required to build courses and to water and maintain them.

This problem has been recognized in the past. A few years ago Jack Nicklaus introduced the CAYMAN ball. This ball, due to its lightness, would only travel about one half the distance of the normal ball and hence permitted a short course to be built on the Cayman Island which is completely lacking in top soil. The result of this experiment was apparently unsuccessful, because the concept now appears to be dormant. An attempt was made to franchise a new golf game featuring a six inch cup and a special set of rules geared to speed play. This also proved to be unsuccessful.

A few golf courses have experimented with additional tees, suggesting that the less skilled players use the most forward tees. This probably would be a good idea if it were not for the "macho" image held by golfers who would refuse to go to a tee in front of the skilled ladies tee box and, of course, there are also unsolved handicap problems involved with this approach.

The problem of minimizing the required land area for a present day championship course totaling approximately 6500–7000 yards for eighteen holes played from the professional tees has not escaped the attention of inventors. U.S. Pat. No. 3,990,708 discloses a golf course wherein all drives are hit on a driving range which is provided with yardage distance markers. The player registers his estimated distance on a display board and, depending on the length of the alleged hole, the display board tells the driver to either "hit again", "register yardage" or "pitch to pitching green". The player then proceeds to hit the second shot for the theoretical hole, which can be either a par 4 or a par 5, and continues hitting from the driving tee until he receives the designation "hit to designated mechanized range green".

The mechanized range green is divided into segments or areas, each representative of a given distance from a flag stick. The areas are defined by a wire mesh material which is supported above the ground surface and intercepts the ball. The ball proceeds over a sloped portion of the mesh to a ball return conduit wherein it actuates a contact switch which indicates to the player which segment the ball is hit onto. The player then goes to an actual putting green and places his ball at the distance indicated by the approach shot which was caught by a segment of the mesh. A minimum of walking is involved, hence expediting the play, The problem with this arrangement is the monotony involved in hitting one, two or three balls from the same driving tee before hitting the ball to land on the mechanized putting green. The entire game of hitting fairway woods or long approach shots from a varying slope terrain is eliminated, and the only true golf shots are the initial drive and the putting on the actual putting green.

A number of patents relating to golf practice areas have been developed which provide the practicing golfer with an indication of the length of his drive by trapping the ball by a net, or a transversely inclined, hard landing area which directs it into a return trough or gutter for actuation of a distance indicator and redelivery to the practice tee. See, for example, U.S. Pat. No. 1,869,642.

In this patent, all drives, regardless of direction, end up in a gutter at the side of the fairway. Hence a ball hit to the right or left of center can register the same yardage as a ball hit down the middle. Only one playable fairway and green are provided, creating monotony rather than the challenge of eighteen different holes.

There is also a large number of patent disclosures wherein the entire golf game is played from a single location. This includes the so-called computerized golf wherein a picture of a famous golf hole appears in front of the player and he hits the drive which is captured by a net or similar target and the distance and direction of the drive is indicated by a computer. The picture then changes to the remainder of the hole so that the player may hit a second shot (or a third shot on a par 5 hole) toward the pictured green. This apparatus is most commonly utilized indoors and provides very little exercise other than the swinging of the club. The patents directed to this concept are too numerous to mention.

Driving ranges with a plurality of greens located at differing distances and directions have also been proposed. See U.S. Pat. 3,599,980.

U.S. Pat. No. 3,708,173 discloses a plurality of driving ranges with each green having 18 flags located thereon. Thus, an entire game of par 3 golf may be played from a single tee by directing the shots at the flag bearing the number of the hole being played. Actual putting of the ball, which constitutes about one third of the normal golf game, is not involved.

Lastly, the concept of combining a single target green with a plurality of driving tees located at varying distances and varying angles with respect to the target tee is disclosed in U.S. Pat. No. 4,063,738. In this arrangement, the second shot is not played from its normal location but from an arbitrary fairway hitting position which represents the remaining yardage for the hole. Thus, deviations in the line of flight of the originally hit ball are not taken into account. The position of the balls on the target green are indicated by three concentric circles surrounding the pin on the target green. All putting strokes are performed at a putting green which is located behind the driving tees and has a separate pin for each hole. The game is played in sequence of first hitting all drives, then hitting all fairway shots, and the approach shots from the tee area, and then moving to the actual putting greens to complete the putting for each hole. Obviously, this procedure bears little resemblance to the normal game of golf, and has not been successful in attracting more players.

Through all of these approaches, it is readily apparent that the problems of reducing the area required for a normal golf course and concurrently speeding up play on the golf course are well recognized in the art, but no desirable solution to the problem has heretofore been provided.

Night playing of the restricted area golf courses is mentioned in a number of the foregoing patents, but none of such patents provide an illumination system which will adequately illuminate the ball in the fairway or rough and the target green, but which will not consume an inordinate amount of energy comparable to that required for the largest stadium bowl. Proper, yet economical lighting of a golf course for night playing has yet to be provided.

SUMMARY OF THE INVENTION

The object of this invention is to provide a reduced area, night playable golf course which solves substantially all of the aforementioned deficiencies of the prior art.

With respect to the reduction of the playing area, this invention contemplates utilizing a plurality of laterally adjacent driving tees from which a player hits his drives for all par 4 and par 5 holes out over a netted area. The netted area effects the trapping of the ball and the directing of the ball into a return chute wherein a contact switch is closed to indicate the position of the ball in the driving area. Both coordinates of the ball position relative to the particular tee are recorded by a computer and are printed on a card provided to the player at the tee.

Each player or group of players hit their drives for all holes requiring the use of a long iron or wooden club appropriate for the distance and layout of the hole. The balls are furnished by the club. There is normally a total of six or seven par 4 and par 5 holes on each nine and the player or group of players proceed to hit all drives for such holes from the same group of practice tees. However, prior to hitting the drive, the player is provided with an overlay chart or a picture showing the actual layout of the hole and the relationship of the netted driving area to the actual hole. Thus, on dogleg holes, the best drive will normally be directed at an angle to the length dimension of the driving netted area so as to best position the ball for the second shot toward the green. Additionally, each drive is hit from a laterally different tee position and directed at a different region of the netted area. On certain holes, water and trap areas can be indicated on the chart provided to the player, and, if his drive does not carry the netted area overlying the water, it will be treated as a ball in the water and his score would be appropriately adjusted. Likewise, balls hit to the extreme left or right portions of the netted area are automatically treated as being out of bounds, requiring the player to tee up a second ball at which point he will be hitting his third stroke on the hole.

After completing the drives on the six or seven holes of the first 9 holes, the player or group of players proceed to an actual golf course which is shortened by the driving areas normally required for par 4 and par 5 holes. Thus, each hole may be at least 150 yards shorter than that indicated by the distance on the player's card. Markers having drive coordinates displayed thereon are provided in the fairway and rough of each hole, and each player proceeds to the marker designated by the coordinates of his drive which, as previously mentioned, are recorded by the computer on the player's card. The player then drops his ball in the area indicated by the drive coordinates and plays the ball to an actual green which is surrounded by sand traps or has a water hazard adjacent to it—all of the niceties associated with normal golf. Once on the green, putting is accomplished from wherever the ball comes to rest. Normal par 3 holes are preferably provided on the course and are played from tee to green.

The player or group of players then proceed to the second hole and again drop their balls in the fairway, rough or trap at the position indicated by the drive coordinates printed on their card for that hole, and proceed to play the second hole in the same manner as on a normal golf course. The second nine is played in the same manner with a second set of driving tees and a second netted area.

Obviously, the afore-described golf course construction permits up to a 50% reduction in ground area for an 18 hole course with a corresponding reduction in acquisition, construction and maintenance costs. Additionally, speed of play is dramatically increased, due to elimination of transit time from each tee to the drive location, plus the elimination of lost ball searching for the drives.

The profitability of a reduced area golf course embodying this invention can be significantly increased by making the course playable at night without incurring inordinate energy costs involved in lighting the entire golf course area.

In accordance with this invention, the driving areas would not be lighted by high intensity perimeter flood lights which shine directly into the player's eyes as he lifts his head at the conclusion of his swing. Instead, the tee area would be lighted by low intensity lights located behind the player. The netted driving area would be illuminated by high flood lights along each edge which are directed out over the netted area, hence away from the player's eyes. A white golf ball hit out into a dark background is surprisingly visible from the tee.

The playing area of each actual hole (which is greatly reduced by the absence of any driving area) is similarly illuminated by pole lights on each edge of the hole that direct the light rays primarily upward and forward, thus producing the desired dark background for observation of the flight of the ball. The edge lights nearer the green are directed less upwardly. The putting area of the green would be illuminated by a light mounted on the top of the pin. Such light would have a reflector to direct the light downwardly in a circular pattern surrounding the hole. Obviously, the pin would remain in the hole during putting. If this is considered a handicap, the diameter of the hole can be increased by an inch or two which will permit the ball to readily fall into the hole if its path lies within the perimeter of the hole.

To accurately indicate where the player's ball should be dropped for the second shot on any hole, low wattage, subsurface lighting units are provided at each coordinate location corresponding to those of the netted driving area. A transparent cover is provided on the top of each subsurface lighting unit and such cover carries the indicia indicating the coordinate location. Thus, the player has no problem in locating the area of drop for his second shot. Obviously, very little power is required for the subsurface lights.

To further reduce the side lighting required, each subsurface lighting unit is provided with a telescoped hollow post which may be grasped and raised to a height of four to five feet by the player. A dimmer resistance normally limits the current drawn by the light bulb to that necessary to illuminate the transparent cover. When the post is raised, a switch is closed to bypass the dimmer resistance, and the bulb generates its full rated output.

An annular conical reflector is provided on the top of the hollow post below the transparent cover to cast a circle of light of ten or fifteen feet in diameter, thus fully illuminating the drop area for the player's second shot. This type of lighting units may be provided in a grid pattern along the entire fairway and rough, and adjacent to sand traps, to provide sufficient temporary illumination for the player to hit the ball, yet not requiring any significant electric power for lighting each hole.

Further objects and advantages of the invention will be readily apparent to those skilled in the art from the following detailed description and the annexed drawings disclosing a preferred embodiment of the invention.

DESCRIPTION OF PREFERRED EMBODIMENT

Figure 1:
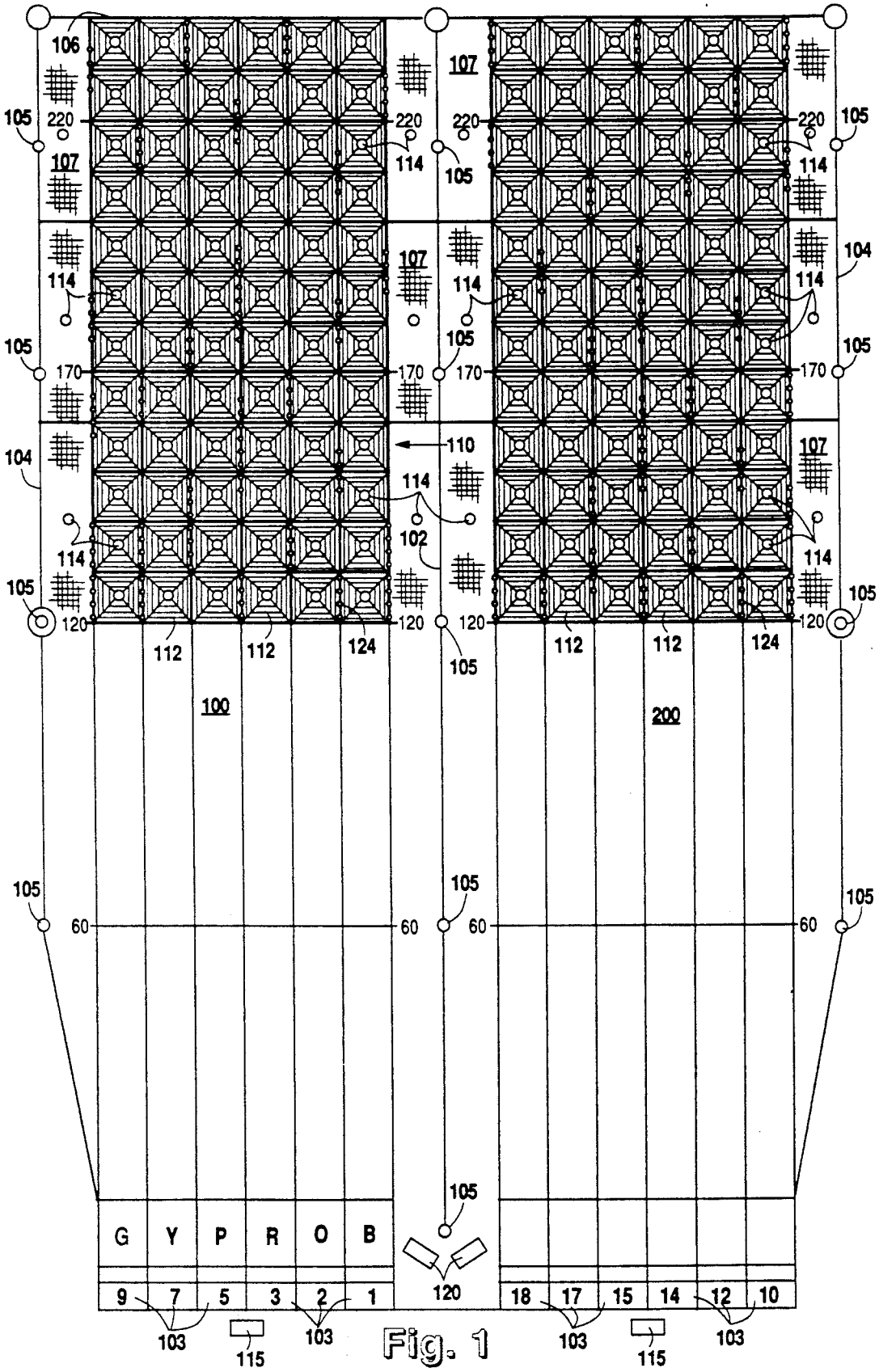
FIG. 1 is a schematic plan view of the driving areas of a reduced area golf course embodying this invention.
Figure 2:
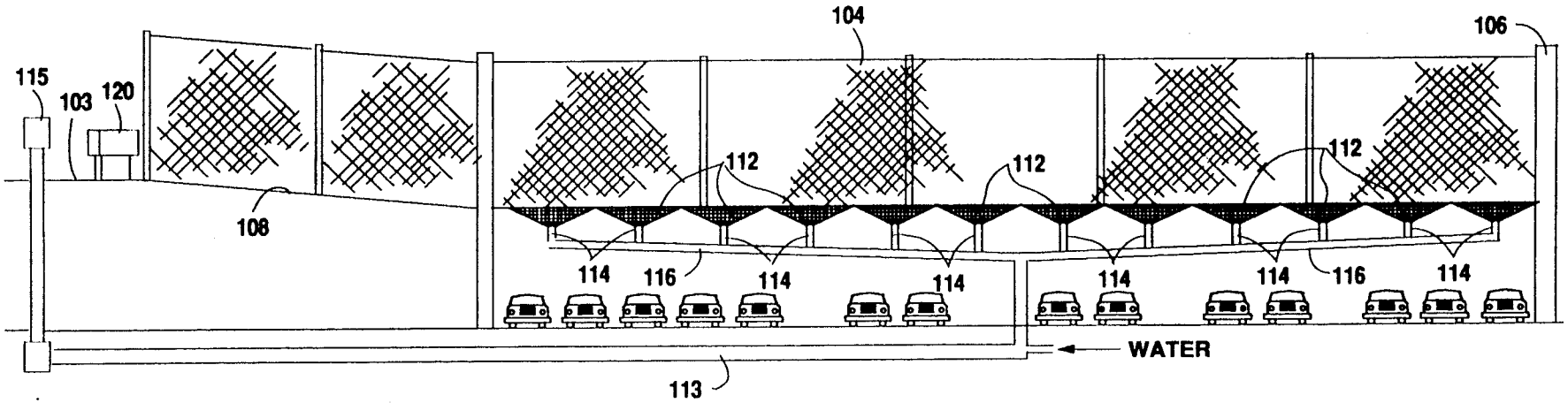
FIG. 2 is a side elevational view of FIG. 1.

Referring to FIGS. 1 and 2, the driving area 100 for the par 4 and par 5 holes of the first nine holes is shown in side by side relationship to the driving area 200 for the par 4 and par 5 holes of the second nine. The driving areas for all par 3 holes are located on the actual course and, therefore, are not shown. Only the driving area 100 will be described in detail since the driving area 200 for the second nine holes is substantially identical. While the driving areas 100 and 200 are shown in side by side relationship, this is not required since they could readily be disposed in angular or spaced relationship to each other depending on the land contour, and desired locations of the clubhouse, tennis courts, swimming pool and other amenities normally associated with a golf course. The side by side arrangement is the most economical since a major portion of a common barrier fence 102 and common light poles 105 can serve both areas.

The opposite side of driving area 100 has a barrier fence 104 and the end of driving area 100 is defined by a barrier fence 106. The driving end of the driving area 100 is provided with 6 or 7 elevated tees 103 for the par 4 and par 5 holes. Assuming there are six such holes on the course, the respective tees are numbered 1, 2, 3, 5, 7, and 9, meaning that holes 4, 6 and 8 are par 3 holes with their respective tees located on the actual golf course.

The letters G, Y, P, R, 0 and B refer to the colors of aiming path lights used for night play, as will be later described.

Referring particularly to FIG. 2, the first 100 to 150 yards of the driving area 100, depending upon how much yardage reduction is desired for the actual par 4 and par 5 holes to be played, is provided with a downwardly sloped, hard surface 108 leading to a ball catching net area 110. Netted area 110 is elevated above ground level by support posts (not shown) to provide a car or cart parking area. In FIG. 1, it is assumed that a 120 yard reduction in yardage for each par 4 and par 5 hole would be appropriate. Hence any drive from the elevated tees for holes 1, 2, 3, 5, 7 and 9 that is less than 120 yards will result in the ball rolling down surface 108 and into the forward end of netted area 110.

As best shown in FIG. 1, the netted area 110 is divided into plurality of ball catching squares 112 having sides of approximately 5 to 10 yards in length. Obviously, the smaller the squares, the greater will be the accuracy in indicating the length of the drive. Each net square 112 has its medial portion depressed to form a low point to which each ball landing in the square will automatically roll. A vertical ball return conduit 114 is connected to such low point and directs the ball into a slightly inclined collection conduit 116 and then into a water powered delivery system 113 which returns the balls to a ball dispenser 115 located on the tee area 103.

Any drive that is incorrectly hit at a sharp angle to hit either of the side barrier fences 102 and 104 is considered to be out of bounds and a second drive must be hit from tee 103 with the appropriate stroke penalty.

An elongated series of ball catching nets 107 are provided along each side barrier fence 102 and 104 to capture all balls hitting a barrier fence 102 or 104. For clarity of illustration, only portions of nets 107 are shown. It is desirable to space the side barrier fences 102 and 104 from the netted area 110 to avoid a player getting the benefit of an out of bounds ball being deflected back into the netted area 110.

Figure 3:
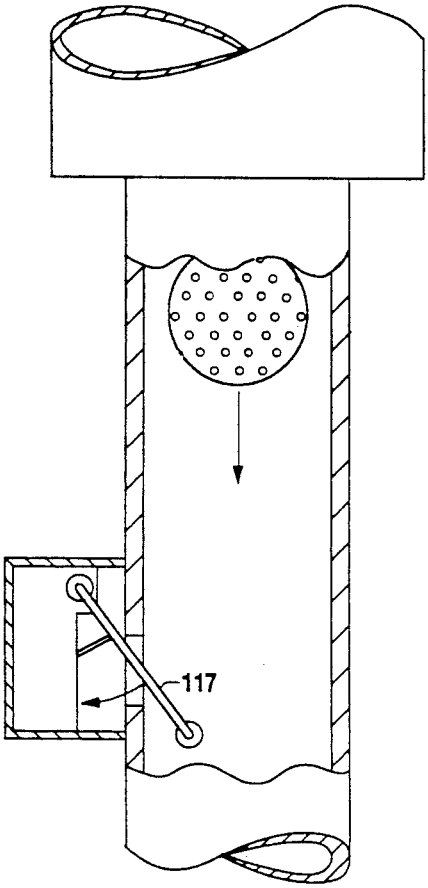
FIG. 3 is an enlarged vertical sectional view of a portion of the ball return conduit containing a ball actuated switch.

As a ball enters any of the vertical ball return conduits 114, a switch 117 (FIG. 3) is opened or closed to provide a signal input to a computer which is preferably located in a control booth (not shown) which is adjacent the driving tees 103. The computer records both the length and transverse position of the drive as indicated by the position of the particular ball catching net square 112 in the netted driving area 110. The ball return conduits 114 for the out of bounds nets 107 are also equipped with switches 117.

A computer access terminal and printer 120 is located on the tee area 103. Such terminal is provided with numbered buttons corresponding to the driving tees 103 and a slot for reception of each player's card. Prior to hitting a drive on a particular hole, the player pushes the button corresponding to such hole and the computer is programmed to record the coordinates of the particular net area 112 in which the drive lands and then print such coordinates on the player's score card in the appropriate space provided for each par 4 and par 5 hole. If desired, the computer can be programmed to compute the remaining distance to the green. This yardage can also be printed for each hole on the player's score card.

At the conclusion of all drives from the tees 103, the computer has printed the coordinates of each drive on the player's score card for the first nine and the player proceeds to the actual golf course.

Before leaving the description of the driving area 100, it should be mentioned that before making any drive, the player is preferably provided with a picture 10 (FIG. 4) of the actual holes he will be playing. The first 100 or 120 yards will be shown as rough, since it does not actually exist. Many score cards in use today have reduced scale pictures of each hole incorporated on the score card, so this is not unusual. More importantly, each player is provided with a transparent overlay 12 of the driving area 100 which is constructed to the same reduced scale as the pictures of the successive holes. By positioning the transparent overlay 12 of the driving area over the picture 10 of the hole to be played, the player can determine the most desirable line of flight and distance for his drive.

Figure 4:
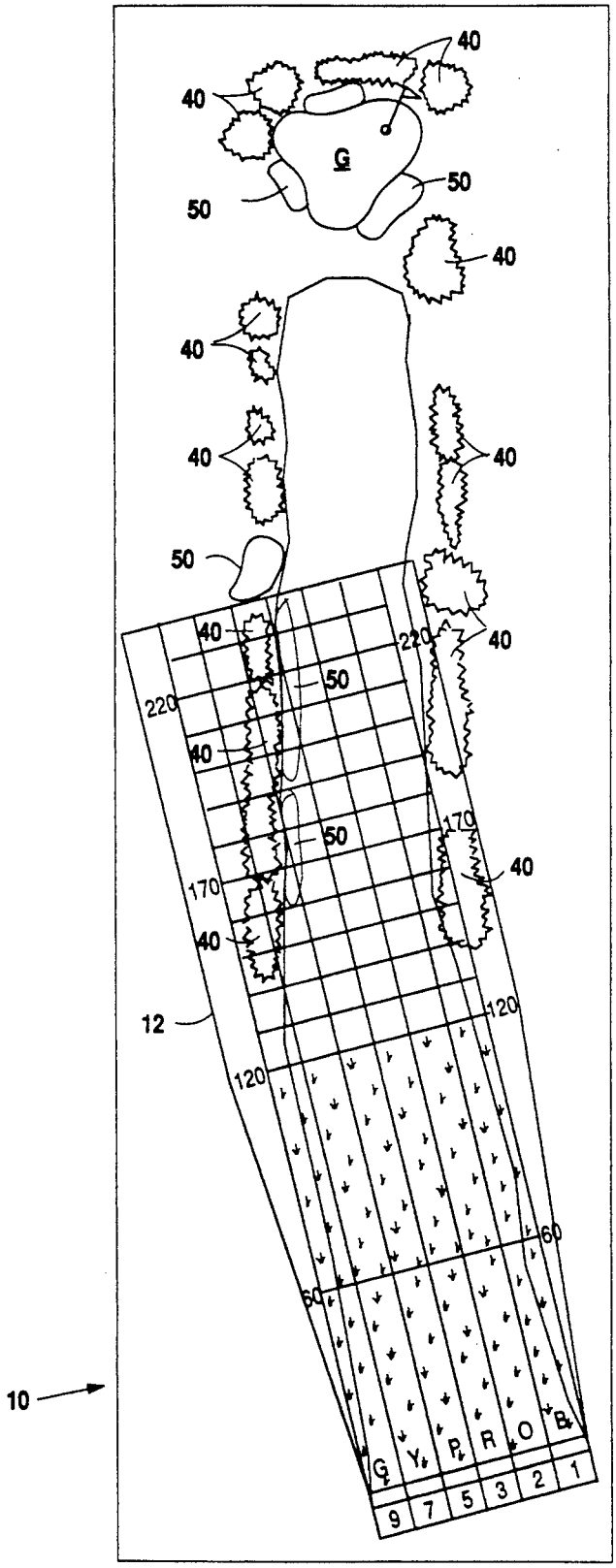
FIG. 4 is a plan view of a typical golf hole on the course with a transparent chart of the netted driving area overlying the initial portion of the hole.

Thus as shown in FIG. 4, the particular hole shown on the picture 10 is a right hand dogleg with trees 40 at the corner and traps 50 opposite the corner. Applying the transparent overlay 12 to the picture 10, indicates to the player that his drive should be directed to the right of the center of the pictured fairway to give him the best position for his second shot. If he is a long hitter, he may elect to hit a long iron or a fairway wood from the tee to avoid overshooting the fairway and entering the traps. The fact that the driving tee for a particular hole is laterally offset also has to be taken into consideration in selecting a desired line of flight for each drive hit.

Figure 5:
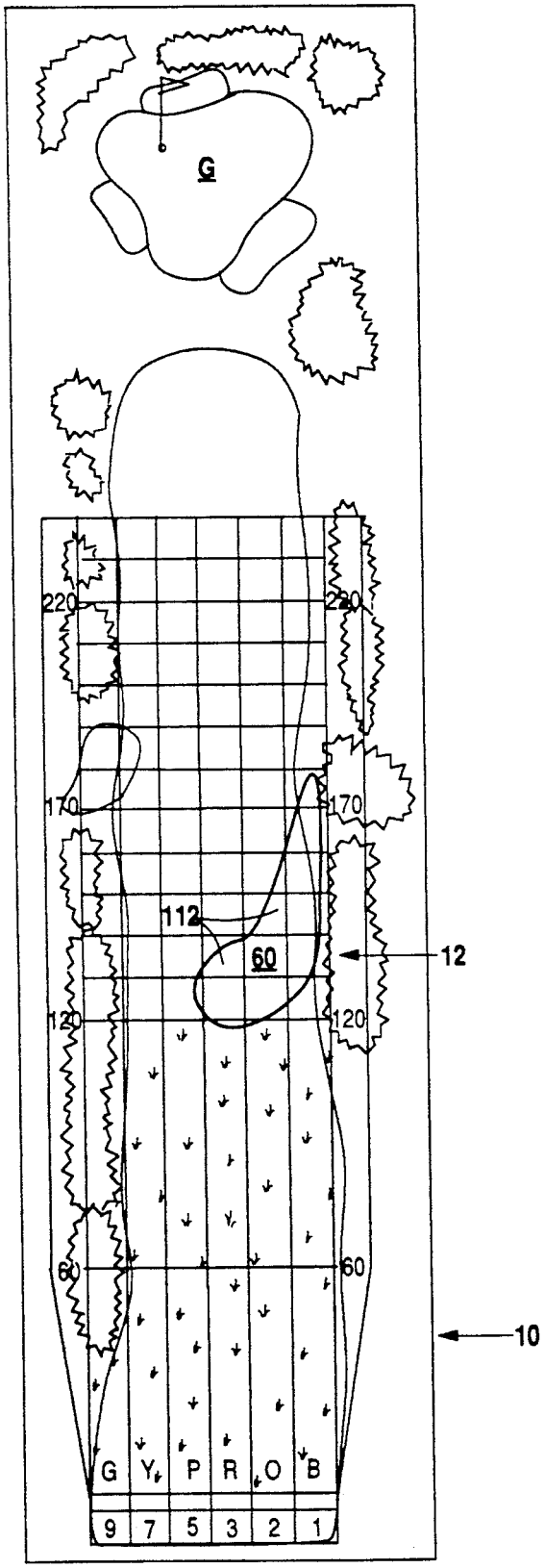
FIG. 5 is a plan view of another hole to be played with a hypothetical water hazard shown in the driving area and the transparent chart of the netted area overlaid thereon.

The afore-described ball catching arrangement, coupled with computer recorded information on the coordinates of the landing area of the ball, permits the addition of hazards to be added to the drives that do not exist on the course. Referring to FIG. 5, the picture furnished the player of the layout of each hole can well include a hypothetical lake 60 requiring a ball flight of more than 150 yards to carry the hypothetical lake. The computer may be programmed to energize a red light on the terminal printer 120 or sound a horn if the ball hit falls into net areas 112 that correspond to the location of the hypothetical lake, requiring the hitting of a second drive. The same technique can be utilized to indicate balls hit out of bounds. The computer is programmed for each hole to provide a signal if the ball falls into the extreme right or left side net areas 107. The picture of the hole furnished the player will indicate the hypothetical position of the out of bounds stakes.

It is, therefore, apparent that a driving area embodying this invention may be utilized to introduce driving hazards that are impossible to achieve on the site of the golf course. Moreover, these hazards may be changed from time to time, or moved to another hole, by the inexpensive act of producing a new picture of the hole with the new hazard introduced and re-programming the computer to recognize appropriate net catching areas 112 as hazards requiring hitting a second drive.

Figure 6:
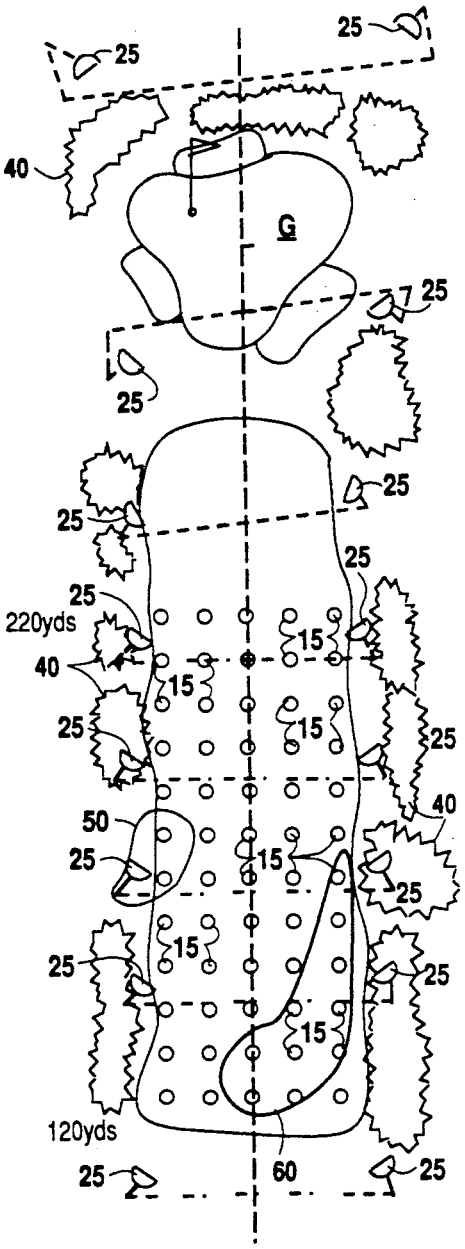
FIG. 6 is a plan view of the hole shown in FIG. 4 with the coordinate markers installed in the drive landing area of the hole.
Figure 7:
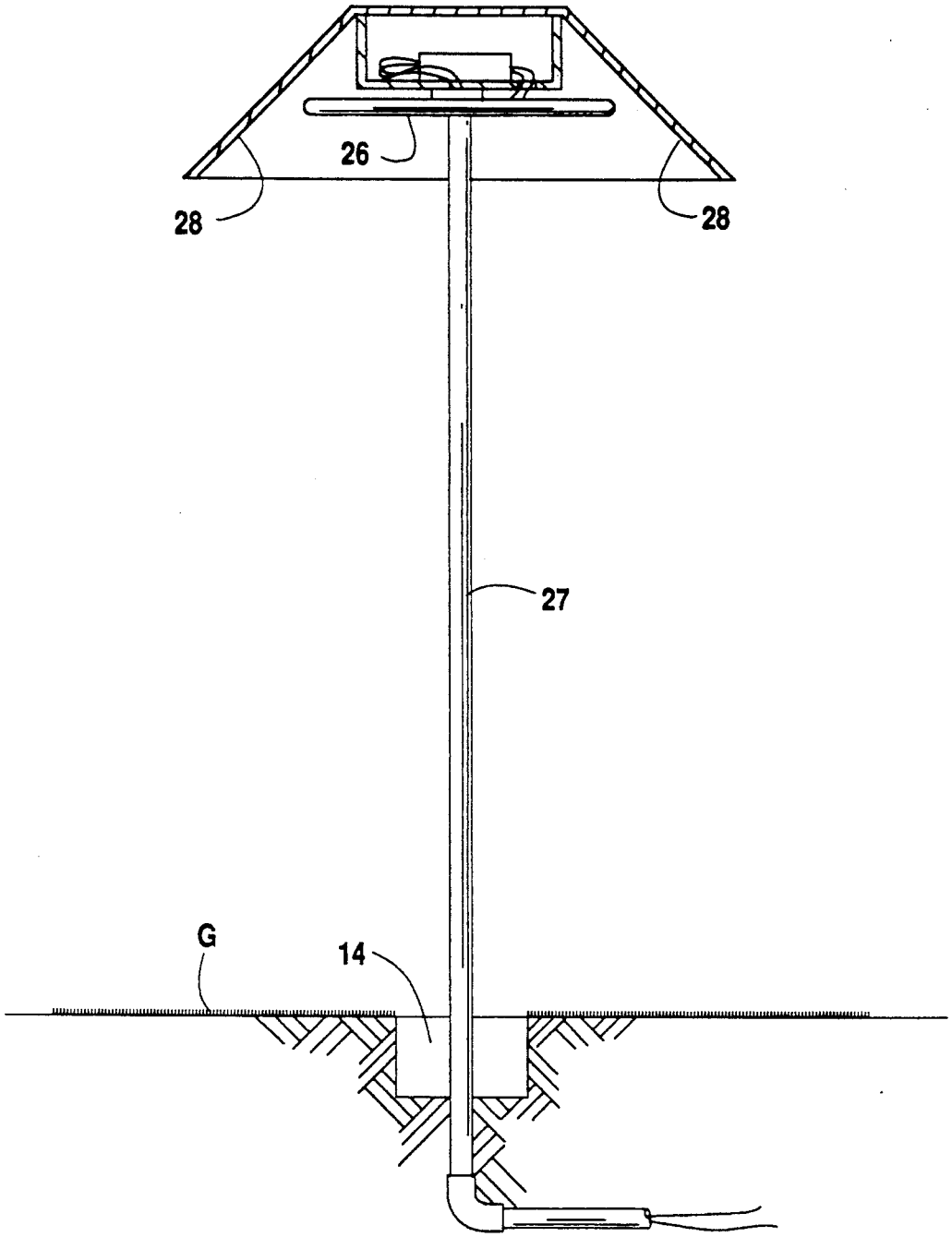
FIG. 7 is a vertical sectional view of a flag pin inserted in a putting hole in the green and mounting a light for night time illumination of the area of the green surrounding the hole.

Let us return to the player who has hit all of the required drives from the driving tees and proceeded to the actual golf course. In accordance with this invention, each par 4 and par 5 hole is provided with a grid of ground level markers 15 bearing indicia indicating the coordinates of the ball catching net that corresponds to the location of the marker on the actual hole. See FIG. 6. Each par 4 and par 5 hole will start at the minimum drive distance, corresponding to the beginning of the ball catching net areas 112 relative to the driving tees 103. The markers are placed in the fairway, rough and traps to conform to the driving coordinates.

The player will locate the ground level marker 15 corresponding to the computer generated coordinates of his drive on the particular hole and drop a ball within a reasonable distance of such marker. The location of the drop may be in the fairway, the rough or a trap.

The player then takes his next stroke, hopefully hitting the ball toward the green G. The remainder of the hole is played conventionally, including putting the ball on the green into the cup. The player then proceeds to the next hole. If that hole is a par 3 hole, it is played normally from tee to green. If it is a par 4 or par 5 hole, the ball is dropped for the next shot adjacent the marker bearing the coordinate indicia for the drive for such hole indicated on the player's score card by the computer. At the conclusion of the first nine holes, the player proceeds to the driving area 200 for the second nine, which is played according to the afore-described procedure for the first nine.

The advantages of the invention insofar as substantially reducing the cost of acquiring land, building the course and then maintaining the course are obvious. The elimination of the first 100 to 150 yards from each par 4 and par 5 hole substantially reduces the size of the course. The driving areas are not entirely additive to the land costs because, as shown in FIG. 2, the netted area 110 can be located above a parking lot or storage space for golf course equipment. The capability of adding or changing hazards in the driving area without moving one shovel of dirt contributes greatly to the appeal of the course to the typical golfer who does not really like to play the same holes day after day.

Lastly, the speed of play is significantly increased as the transit time from tee to the location of the drive is eliminated on all the long holes. There are no lost balls to be located after the drive. Yet all conventional strokes and lies of the ball will be encountered as are found on a full size golf course.

Some players may object to the use of the ball catching netted areas 112 on the ground that their drives are being arbitrarily shortened by elimination of roll of the ball in actual play after it strikes the ground. This criticism can actually be turned into a unique advantage for this invention due to the incorporation of a computer in the coordinate reporting system for the drives.

Every golfer will admit that, when the course is wet and soft, very little roll occurs after the drive hits the ground, while when the course is sun baked, or frozen and hard, a drive will have a substantial roll.

The coordinate recording computer is provided with at least three buttons, one for soft course conditions, one for normal conditions and the third for hard ground conditions. If the player (or pro) believes the course is soft, he pushes the first button. The computer is then programmed to add a minimal amount of yardage, say 5 yards to each distance coordinate. If normal conditions exist, pushing the second button will program the computer to add a greater yardage, say 15 yards, to the distance coordinate. If hard ground conditions exist, pushing the third button will program the computer to add still more yardage, say 25 yards, to the recorded distance coordinate.

Thus, the distance of drives reported by the computer is completely adjustable to reflect the actual condition of the course the time of play, and no penalty is imposed on the player by catching the drive with a netted area.

If economical illumination can be provided, the usage factor of the course may be substantially increased. After all, there are far more golfers who can play at night than during daylight hours. While the reduced area of a golf course embodying this invention contributes to reduction of night lighting costs, such costs are still very substantial.

This invention provides a night lighting system for conventional or reduced area golf courses that will reduce night lighting costs to an economically feasible level. The driving area 100 has modest wattage lights positioned behind each of the driving tees 103. Such lighting is preferably downwardly directed to primarily illuminate the ground of the tee area. Flood lights (not shown) are mounted on light poles 105 positioned along both sides of driving area 100, but care should be taken to direct such lights forwardly, away from tees 103, so that the player never looks up after hitting the ball into the glare of a light. It follows that the ball is hit into a dark background, and is surprisingly visible to the player. Stadium type lighting of the entire driving area is not required.

To assist the player in aiming his drive to a selected region of the netted area 110, lines of low wattage lights 124 (not all of which are shown), such as employed for Christmas lighting, are mounted below the net in parallel lines with each line having a different color. As previously mentioned, such colors are shown in FIG. 1 to be successively green, yellow, pink, red, orange and blue, as shown by the initials G, Y, P, R, 0 and B. Any other selection of colors may be used so long as the player can aim his drive at a specific lateral region of the driving area which he selected through use of the transparent overlay of the driving area applied to a picture of the particular hole.

On the actual golf course, the tee areas for the par 3 holes are illuminated by pole lights (not shown) located behind the tees 103 and casting light downwardly on the tee area. Edge lighting is provided along each side of each hole by low wattage halogen lights 25 which are directed forwardly and upwardly to provide a dark background against which the flight of the ball may be readily observed.

Each green is primarily illuminated by a light 26, which can be a fluorescent circle mounted on the top of a hollow flag pin 27 and reflected downwardly by a reflector 28 to cast a circle of light of not more than a twenty foot radius around the hole H in which the flag pin is fixedly mounted. Any complaint as to the reduced area of the cup can be met by increasing the diameter of the hole to provide the same area of drop as when a conventional flag pin is removed from the cup for putting.

Figure 8:
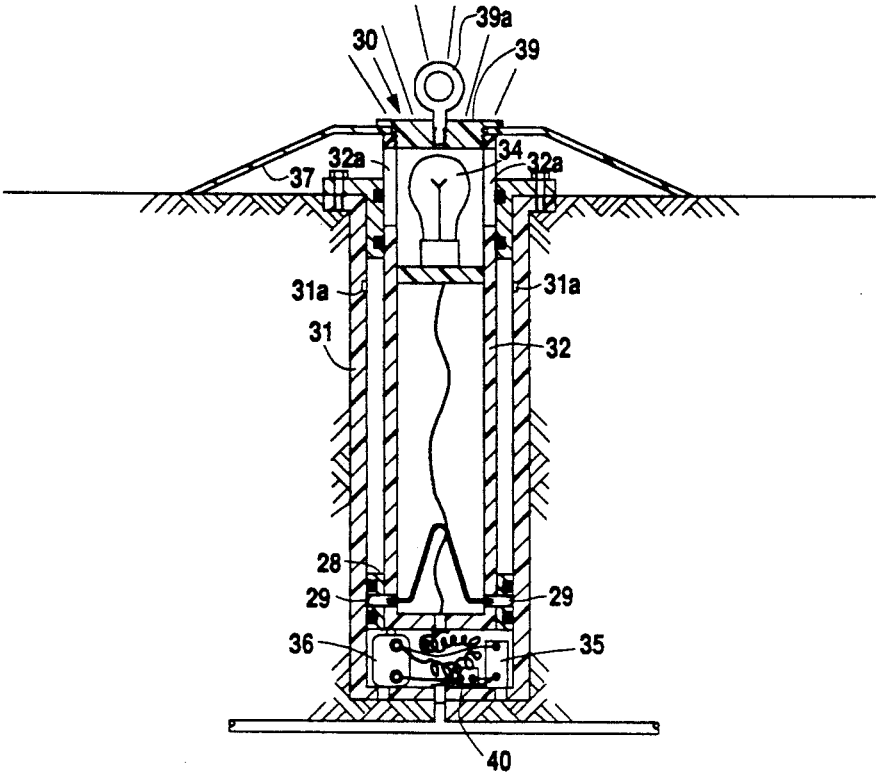
FIG. 8 is a vertical sectional view of a combined coordinate and light for illuminating a ball located within a reasonable distance from the marker for night play.
Figure 9:
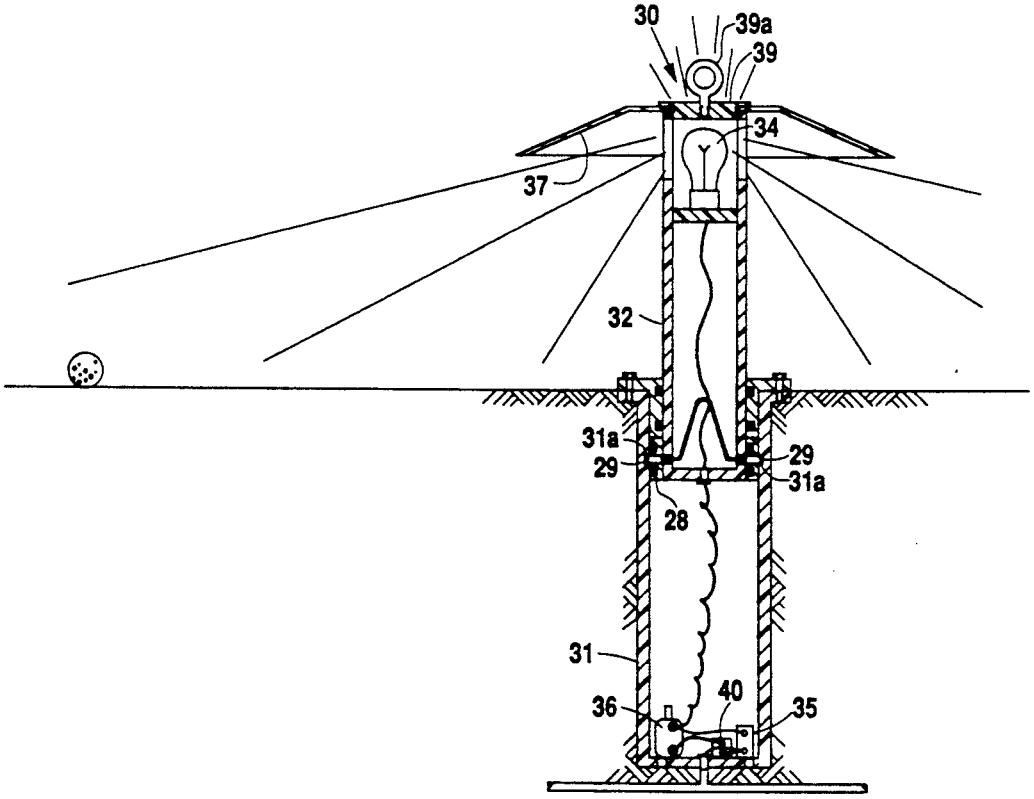
FIG. 9 is a view similar to FIG. 8 but showing the light carrying portion of the marker in its elevated position to illuminate the area adjacent to the marker.

Probably the most important lighting elements are units 30, which also show the location of the drive coordinates. In accordance with this invention, each lighting unit 30 comprises a hollow tube 31, (FIG. 8), preferably not more than five feet in length, which is set into the ground with its top end not exceeding ground level. An inner tube 32 is telescopically and sealably mounted within tube 31 and is vertically movable between a fully inserted position (FIG. 8) with its upper end substantially at ground level, and an elevated position (FIG. 9). Spring pressed detents 29 in seal rings 28 secure inner tube 32 in the elevated position.

A relatively low wattage light bulb 34, around 40 watts, is mounted within the bore of inner tube 32 and is energized by a buried cable (not shown) through a dimmer resistance 35. A normally open limit switch 36 is mounted in shunting relationship to the dimmer resistance 35 so that only a low intensity light beam is generated by light bulb 34 when the inner tube 32 is in its fully inserted position in outer tube 31. An annular reflector 37 is supported on the top of inner tube 32 and a transparent plastic cap 39 is threaded into inner tube 32 and secures the annular reflector 37 in position. Alternatively, the transparent cap may be radially enlarged and an annular coating of reflecting material applied to the under side of the transparent cap 39. Slots **32*a* in the top portion of inner tube 32 permit light from bulb 34 to strike annular reflector 37**.

Thus, when the inner tube 32 is in its fully inserted position in outer tube 31, dimmer switch 36 is open and only a low intensity light shines upwardly through the open center of annular reflector 37 and through transparent cap 39, permitting the position of each unit 30 to be readily detected, whether in the fairway or rough. The lighting units 30 are disposed over the entire playing area of each hole in a square grid pattern with those units 30 in the drive landing area of the hole being located to correspond to the location of the centers of the ball catching net areas 112, thus serving the function of markers 15.

Each transparent cap 39 is colored and carries coordinate indicia on its upper surface corresponding to the coordinates and color of a ball catching net areas 112. Each player can thus readily locate the position at which his ball should be dropped to play the second shot. The player grasps a hook or handle **39*a* on the transparent cover 39 and elevates inner tube 32 to the position where detents 29 are engaged an annular groove 31*a* provided in the outer tube 31. This moves inner tube 32 out of the outer tube 31, closes switch 36 and permits light bulb 34 to develop its full intensity, thus casting a circle of light on the ground immediately surrounding lighting unit 30 so that the dropped ball can be hit. When the inner tube 32 is pushed downwardly to its ground level position, the switch 36 is opened to reinsert the dimmer resistance in the circuit for light bulb 34. If the player forgets to lower the lighting unit 30, a timer switch 40 conventionally connected in the energization circuit for light bulb 34 operates to return it to its low energy, dimmed condition. Alternatively, a second light bulb may be provided in the tubes 31 and 32 which is not energized until the inner tube 32 is elevated from the subsurface outer tube 31**, which activates a switch and, if desired, a timer to turn off the second light after a few minutes.

It is readily apparent to those skilled in the art that the total energy requirements of a golf course lighting system embodying this invention is only a small fraction of that heretofore required. In effect, only a small portion of each hole is illuminated sufficiently to permit a ball to be hit, yet the target for each stroke of the ball is clearly visible.

Modifications of this invention will be readily apparent to those skilled in the art of golf course design and illumination, and it is intended that all such modifications fall within the scope of the appended claims.

What is claimed and desired to be secured by Letters Patent is:

1. A restricted area golf course permitting play over a plurality of different full size holes, including par 3, and par 4, and par 5 length holes, comprising:

an outdoor driving area;

a driving tee generally facing said driving area;

an outdoor playing area having a plurality of full length par 3 holes and a plurality of par 4 and par 5 holes each having its own fairway leading to its own putting green;

each par 4 hole and each par 5 hole being shortened by elimination from each par 4 and par 5 hole of any driving tee and an adjacent area of from about 100 to 150 yards long that would normally precede the initial portion of the fairway of the respective hole;

chart means comprising a first printed sheet for indicating to each player on the driving tee the layout of each par 4 or par 5 hole in said playing area, and a second transparent sheet showing said driving area and driving tee superimposed on the beginning of each said par 4 or par 5 hole printed on said first sheet;

a generally horizontal net suspended above said driving area by spaced supports to divide the net into a plurality of generally rectangular, centrally sagged, ball catching net areas;

a ball return conduit communicating with the sagged portion of each of said ball catching net areas;

means responsive to movement of a ball through any said ball return conduit for indicating to the player the coordinates of the respective ball catching net area expressed in both distance from the driving tee and lateral displacement from the center line of said driving area, whereby the player can successively hit a drive for each par 4 and par 5 hole from said driving tee and receive a card indicating the coordinates of each such drive; and means on each par 4 and par 5 hole in said playing area for indicating the same coordinate locations as provided for said driving net areas, whereby the player may drop his ball successively on each par 4 and par 5 hole in said playing area at a location relative to the green indicated by the coordinates of his drive on the respective hole and finish playing the hole in the normal manner, including putting on said putting green for said hole.

2. The restricted area golf course of claim 1 wherein a first driving area is provided for the first nine holes and a second driving area for the second nine holes;

a grid of ball catching nets overlying said first and second driving area;

said first driving area being utilized solely for driving the par 4 or par 5 holes of the first nine holes and said second driving area being utilized solely for driving the par 4 and par 5 holes of the second nine holes.

3. The golf course of claim 1 wherein said driving tee is laterally divided to provide a different tee position for each par 4 and par 5 hole.

4. The restricted area golf course of claim 1 further comprising means for illuminating said driving area by lights directed away from the player to permit hitting the ball into a dark background;

subsurface lighting means located on each of the par 4 and par 5 holes at positions corresponding to the coordinates of said net areas;

said subsurface lighting means being manually liftable to cast a light beam on a limited area surrounding said lighting means sufficient to permit a ball to be dropped and hit toward the green; and means for illuminating the area of each green surrounding the hole.

5. The golf course of claim 4 further comprising a translucent cover on said subsurface lighting means;

position coordinates on said translucent cover;

said translucent cover transmitting only sufficient light to make the location of said subsurface lighting means visible to the player.

6. The restricted area golf course of claim 4 further comprising low intensity lights spaced along the lateral boundaries of each playable hole and directed toward the respective green, whereby the flight of the ball may be observed against a relatively dark background.

7. The golf course of claim 4 wherein said means for illuminating the green area surrounding the hole comprises:

a mast inserted in the putting hole in each green; and a downwardly directed light source positioned on the top of said mast and illuminating the area of the green surrounding the putting hole.

8. A restricted area golf course permitting play over a plurality of full size holes, including par 3, par 4 and par 5 length holes, comprising:

an outdoor driving area;

a driving tee generally facing said driving area;

an outdoor playing area having a plurality of full length par 3 holes and a plurality of par 4 and par 5 holes;

each of said par 4 and par 5 holes having its own fairway leading to its own putting green;

each par 4 hole and par 5 hole being shortened by elimination from each par 4 and par 5 hole of any driving tee and an adjacent area of from about a hundred to a hundred and fifty yards long that would normally precede the initial portions of the fairway of the respective hole;

chart means comprising a first printed sheet for indicating to each player on the driving tee the layout of each par 4 or par 5 hole in said playing area, and a second transparent sheet showing said driving area, driving tee and any selected hazard superimposed on the beginning of each said par 4 or par 5 hole printed on said first sheet;

a generally horizontal net suspended above said driving area by spaced supports to divide the net into a plurality of generally rectangular, generally sagged, ball catching net areas;

a ball return conduit communicating with the sagged portion of each of said ball catching net areas;

means responsive to movement of a ball through any said conduit for indicating to the player either (1) the coordinates of the respective ball net area expressed in both distance from the driving tee and lateral displacement from the center line of the driving area, whereby the player can successively hit a drive for each par 4 and par 5 hole from said driving tee and receive a card indicating the coordinates of each drive; or (2) the fact that the ball has landed in a net area corresponding to a non-playable hazard requiring a second drive to be hit; and means on each par 4 and par 5 hole in said playing area for indicating the same coordinate locations as provided for said driving net areas, whereby the player may drop his ball on each said par 4 and par 5 hole in said playing area at a location relative to the green indicated by the coordinates of his drive on the respective hole and finish playing the hole in the normal manner, including putting on said putting green for said hole.

9. A night playable golf course having a plurality of fairways respectively leading to putting greens comprising, in combination:

means for illuminating each side of each fairway by lights directed toward the respective green, thereby permitting observation of the flight of a golf ball against a relatively dark background;

subsurface lighting means located in a spaced grid relationship in the fairway;

said subsurface lighting means being manually liftable to illuminate a limited area of the surrounding ground sufficient to permit the hitting of a golf ball toward the green, each said green having a putting hole at a selected location on the green; and means for illuminating the area of the green surrounding the putting hole.

10. The night playable golf course of claim 9 further comprising a translucent cover on said subsurface lighting means;

said translucent cover transmitting only sufficient light to make the location of said subsurface lighting means visible to the player.

11. The night playable golf course of claim 9 wherein said subsurface lighting means comprises an outer hollow housing having a bottom and inserted in the ground and a top end being substantially at ground level;

an inner housing telescoped within said outer housing and manually liftable to an elevated position;

electric light means mounted within said housings to project a beam of light upwardly; and annular reflector means mounted on said upper end of said inner housing to project a circle of light downwardly on the ground area surrounding said outer housing to permit hitting of a golf ball located within said light circle.

12. The night playable golf course of claim 10 further comprising a dimmer resistance connected in series with said electric light means; and electric switch means responsive to the elevation of said inner hollow housing to shunt said dimmer resistance, whereby said electric light means draws full electric current only during the time said inner housing is elevated.

13. The night playable golf course of claim 11 wherein said reflector means includes a limited light passage area to permit the location of said housings to be observed at night.

14. The golf course of claim 9 wherein said means for illuminating the area of the green surrounding the putting hole comprises a mast inserted in said putting hole, and a light source positioned adjacent the top of each said mast.

* * * * *

UNITED STATES PATENT AND TRADEMARK OFFICE

CERTIFICATE OF CORRECTION

PATENT NO. : 5,265,875

DATED : November 30, 1993

INVENTOR(S) : John H. FitzGerald

It is certified that error appears in the above-indentified patent and that said Letters Patent is hereby corrected as shown below:

On the title page, item [76]: correct inventor's name from John H. Fitzgerald to --John H. FitzGerald--

Signed and Sealed this

First Day of March, 1994

Bruce Lehman

*Attest:*

BRUCE LEHMAN

*Attesting Officer*

*Commissioner of Patents and Trademarks*